US005964198A

United States Patent [19]

Wu

[11] Patent Number: 5,964,198

[45] Date of Patent: Oct. 12, 1999

[54] LUBRICATION SYSTEM OF INTERNAL COMBUSTION ENGINE

[75] Inventor: Yuh-Yih Wu, Taipei City, Taiwan

[73] Assignee: Industrial Technology Research Institute, Hsinchu, Taiwan

[21] Appl. No.: 09/067,919

[22] Filed: Apr. 29, 1998

[51] Int. Cl.[6] ..... F01M 1/00

[52] U.S. Cl. ..... 123/196 R; 123/196 CP; 123/198 C

[58] Field of Search ..... 123/196 R, 196 CP, 123/198 C, 48 AA, 525, 196 AB, 61 R, 327

[56] References Cited

U.S. PATENT DOCUMENTS

| | | | |
|---|---|---|---|
| 3,143,187 | 8/1964 | Stefan | 184/6.24 |
| 4,329,952 | 5/1982 | Buraas | 123/196 AB |
| 4,462,350 | 7/1984 | Kurata | 123/196 CP |
| 4,512,299 | 4/1985 | Egan et al. | 123/196 AB |
| 4,541,368 | 9/1985 | Castarede | 123/196 AB |
| 4,545,334 | 10/1985 | Nakagawa et al. | 123/196 AB |
| 4,703,726 | 11/1987 | Sekiya et al. | 123/198 C |
| 4,715,793 | 12/1987 | Johann et al. | 417/300 |
| 4,898,207 | 2/1990 | Ueki et al. | 123/196 R |
| 5,152,264 | 10/1992 | Evans | 123/198 |
| 5,249,556 | 10/1993 | Emmitt | 123/196 CP |
| 5,570,662 | 11/1996 | Niemchick et al. | 123/196 CP |
| 5,649,514 | 7/1997 | Okada et al. | 123/509 |
| 5,662,089 | 9/1997 | Kleppner et al. | 123/509 |
| 5,685,266 | 11/1997 | Hudson | 123/196 R |
| 5,765,521 | 6/1998 | Stutzle et al. | 123/198 C |
| 5,787,854 | 8/1998 | Uhlig et al. | 123/196 R |

*Primary Examiner*—Noah P. Kamen
*Assistant Examiner*—Jason Benton
*Attorney, Agent, or Firm*—Browdy and Neimark

[57] ABSTRACT

A lubrication system of an internal combustion engine is composed of an engine oil case and an engine oil pump located in the engine oil case such that an inlet of the engine oil pump is located in proximity of a geometrical center of the interior of the engine oil case. The engine oil kept in the engine oil case can be thus conveyed efficiently to all moving parts of the internal combustion engine even at the time when the internal combustion engine is tilted.

14 Claims, 7 Drawing Sheets

LUBRICATION SYSTEM OF INTERNAL COMBUSTION ENGINE

FIELD OF THE INVENTION

The present invention relates generally to an internal combustion engine, and more particularly to a lubricating system of the internal combustion engine.

BACKGROUND OF THE INVENTION

An internal combustion engine is composed of many moving parts, which have to be lubricated thoroughly to minimize the mechanical friction at the time when the internal combustion engine is in operation.

The lubrication of the moving parts of a traditional compact two-stroke engine is brought about by a mixture of engine oil and engine fuel in the ratio of about 1:25. Such a lubrication system as described is defective in design in that the engine oil contained in the mixture can not be burned completely in the combustion chamber of the two-stroke engine, thereby resulting in the discharge of exhaust fume that is a potential environmental pollutant.

The lubrication system of a conventional compact four-stroke engine consists of a slinger rod, through which the engine oil kept at the bottom of the crank case is applied to the moving parts of the engine in the form of oil mist. This kind of the engine lubrication system is ineffective at best in view of the fact that certain moving parts of the engine are not lubricated at the time when the engine is tilted, as is often the case with a chain saw or hedge trimmer, and that the engine oil may be accidentally introduced into the cylinder or combustion chamber at the time when the engine is tilted, thereby resulting in the discharge of harmful exhaust fume.

An improved engine lubrication system is composed of a crank shaft on which the engine oil case is mounted. The crank shaft is provided with a slinger, through which the engine oil is applied to all moving parts of the engine in the form of oil mist. This lubrication system is limited in design in that the lubricating effect of oil mist is confined within bounds, and that the plain bearing and the overhead cam (OHC) can not be lubricated by oil mist, and further that the oil mist can be easily diminished by the engine breather, thereby resulting in an excessive consumption of engine oil.

SUMMARY OF THE INVENTION

It is therefore the primary objective of the present invention to provide a lubrication system capable of lubricating effectively all moving parts of an internal combustion engine even at such time when the internal combustion engine in operation is tilted.

It is another objective of the present invention to provide an engine lubricating system with an independent engine oil case and an engine oil pump located in the engine oil case for enhancing the lubricating effect and minimizing the consumption of engine oil as well as the discharge of the harmful exhaust fume.

In keeping with the principle of the present invention, the foregoing objectives of the present invention are attained by an engine lubricating system consisting of an engine oil case and an engine oil pump. The engine oil case can be independent of the engine. The engine oil pump is located in the engine oil case such that an inlet of the engine oil pump is located in proximity of a geometric center of the interior of the engine oil case, and that the engine oil contained in the engine oil case can be thus efficiently pumped out to lubricate all moving parts of the engine even at the time when the engine in motion is tilted.

The foregoing objectives, features, functions, and advantages of the present invention will be more readily understood upon a thoughtful deliberation of the following detailed description of the embodiments of the present invention with reference to the accompanying drawings.

DETAILED DESCRIPTION OF THE INVENTION

Figure 1:
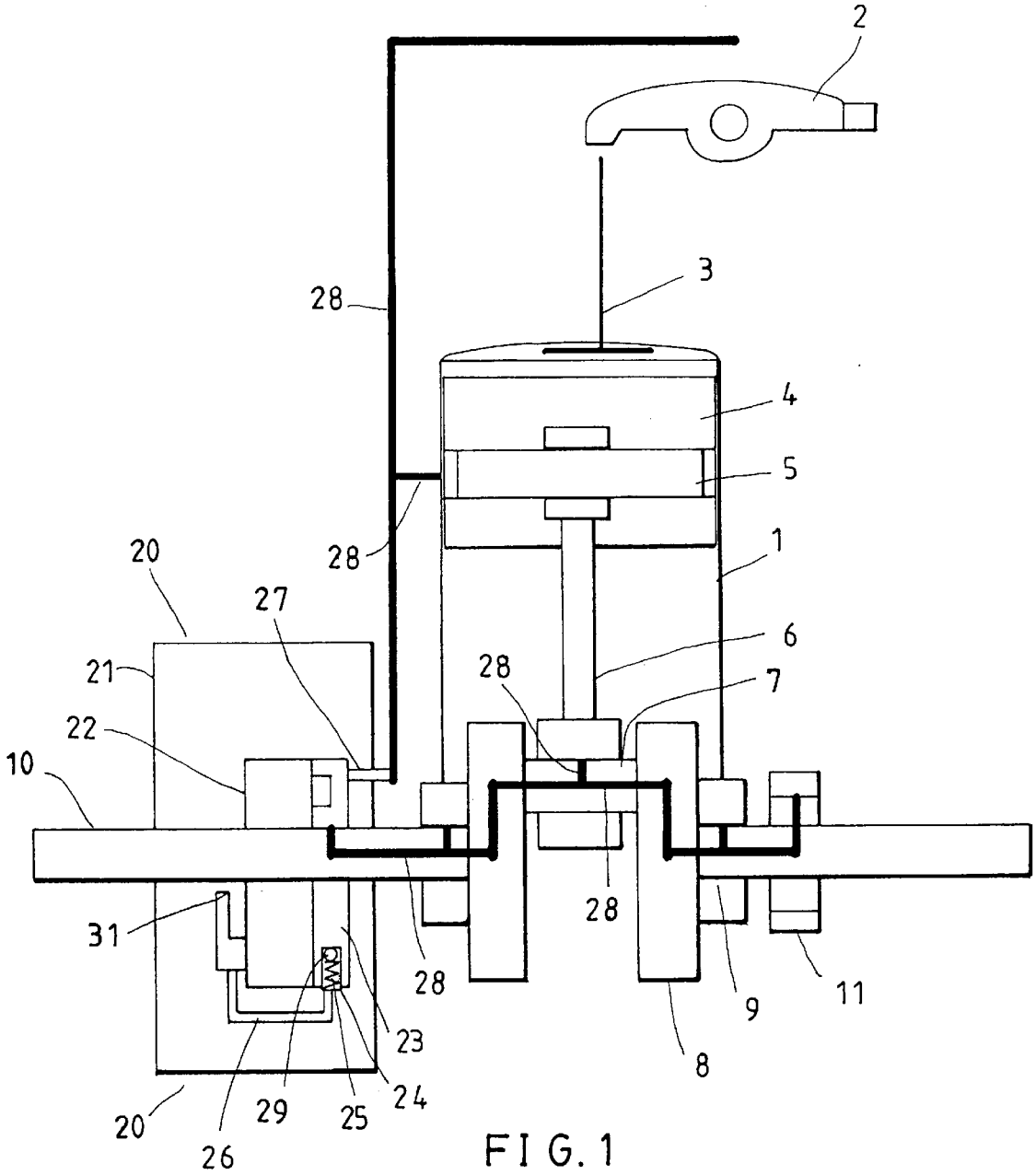
FIG. 1 shows a schematic view of the working principle of the present invention.
Figure 2A:
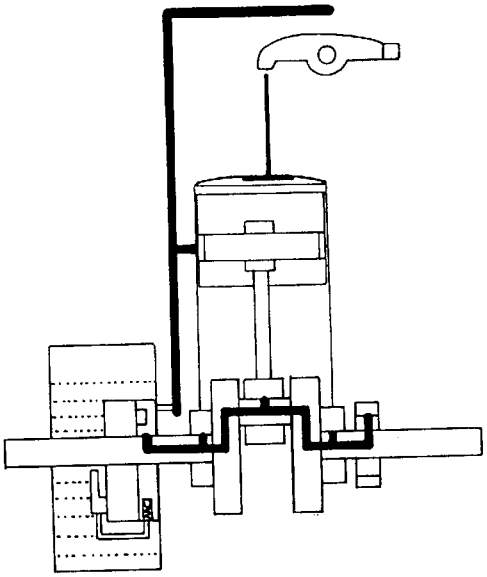
FIG. 2 includes schematic views illustrating the operations of the present invention at such time when the engine is tilted in various ways.
Figure 2B:
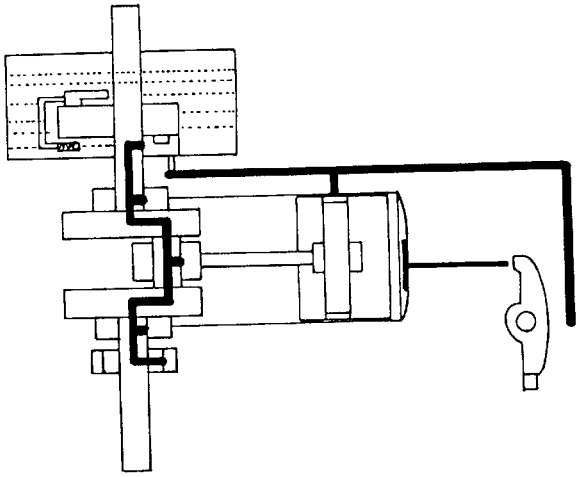
Figure 2C:
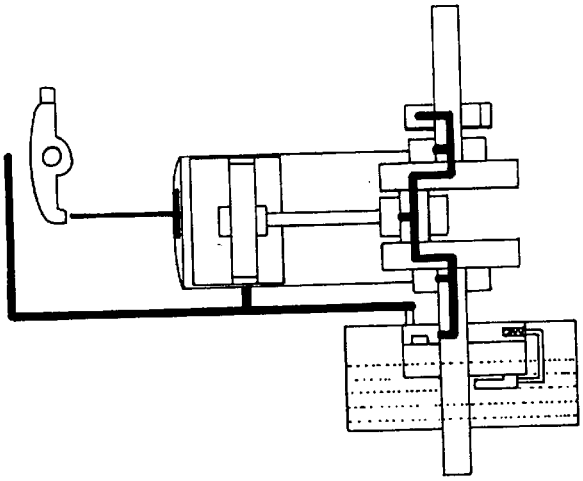
Figure 2D:
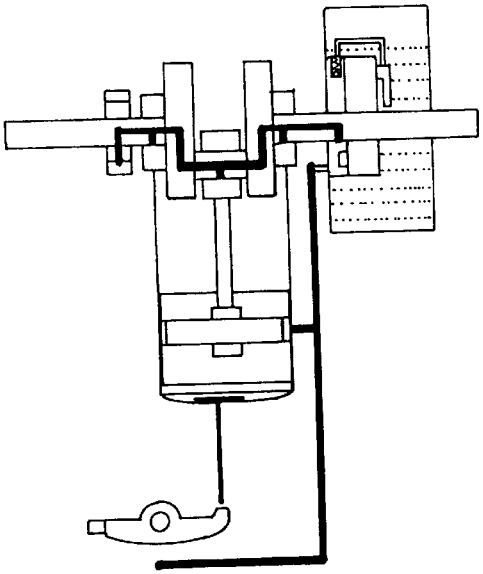

As illustrated in FIG. 1, an engine lubricating system 20 embodied in the present invention is mounted on a four-stroke engine, which consists of a cylinder 1, a rocker arm 2, a valve system 3, a piston 4, a piston pin 5, a connection rod 6, a crank pin 7 connected, a counter weight 8, a main bearing 9, a crankshaft 10, and a timing gear 11.

The lubricating system 20 of the present invention is composed of an engine oil case 21 and an engine oil pump 22 located in the engine oil case 21 such that the oil pump 22 is directly driven by the crankshaft 10 of the engine. The amount of the engine oil output of the oil pump 22 is precisely equal to the amount that is required for lubricating the engine in operation. The engine oil pump 22 is provided with an inlet 31 which is located in proximity of the geometrical center of the interior of the engine oil case 21. As a result, the engine is thoroughly lubricated even at the time when the engine is tilted. The engine oil pump 22 is provided with an outlet which is in turn provided with a high-pressure chamber 23. The high-pressure chamber 23 is provided therein with a pressure releasing valve 24, which is similar in construction to an ordinary pressure regulator. The pressure of the high pressure chamber 23 is set by means of a spherical ball 29 and a spring 25. When the engine oil pressure exceeds the set value of the pressure releasing valve 24, a certain amount of the engine oil is introduced into the pressure releasing valve 24 and is then released. The pressure releasing valve 24 is provided with a pressure releasing oil conduit 26, which is connected with the inlet of the engine oil pump 22 for preventing the engine oil pressure in the high-pressure chamber 23 from becoming excessive to result in an increase in the power consumption by the crankshaft 10 to drive the engine oil pump 22. It must be noted here that the crankshaft 10 is put through the high-pressure chamber 23. The engine oil is conveyed from the outlet of the high-pressure chamber 23 of the engine oil pump 22 to lubricate the engine parts via the oil conduit 27 or the internal oil ducts 28 of the engine parts. The oil conduit 28 is located in the crankshaft 10 for conveying the engine oil from the high-pressure chamber 23 to the main bearing 9, the crankshaft pin 7, the time gear 11. The cylinder 1 is also provided therein with an oil duct 28 for conveying the engine oil from the high-pressure chamber 23 to the cylinder 1, the piston 4, the piston pin 5, the valve system 3 and the rocker arm 2. The area of the outlet of the oil duct can be so adjusted as to optimize the flow of the engine oil to the engine part which is to be lubricated.

As illustrated in FIGS. 2A, 2B, 2C and 2D, the engine oil pump 22 of the present invention is always able to pump the engine oil to lubricate the engine parts even if the engine is turned 90 degrees, 180 degrees, or 270 degrees, thanks to the unique design of the engine lubricating system 20 of the present invention.

According to the present invention, the engine oil is conveyed by the pump pressure. As a result, a pressure oil film is formed on the surface of the bearing. The roller or ball bearing may be replaced by the plain bearing to reduce the cost and weight. In light of the engine oil case 21 of the present invention, the crank case is devoid of engine oil. As a result, the compressed gas in the crankshaft case may serve as boost pressure for enhancing the engine torque and horsepower.

Figure 3:
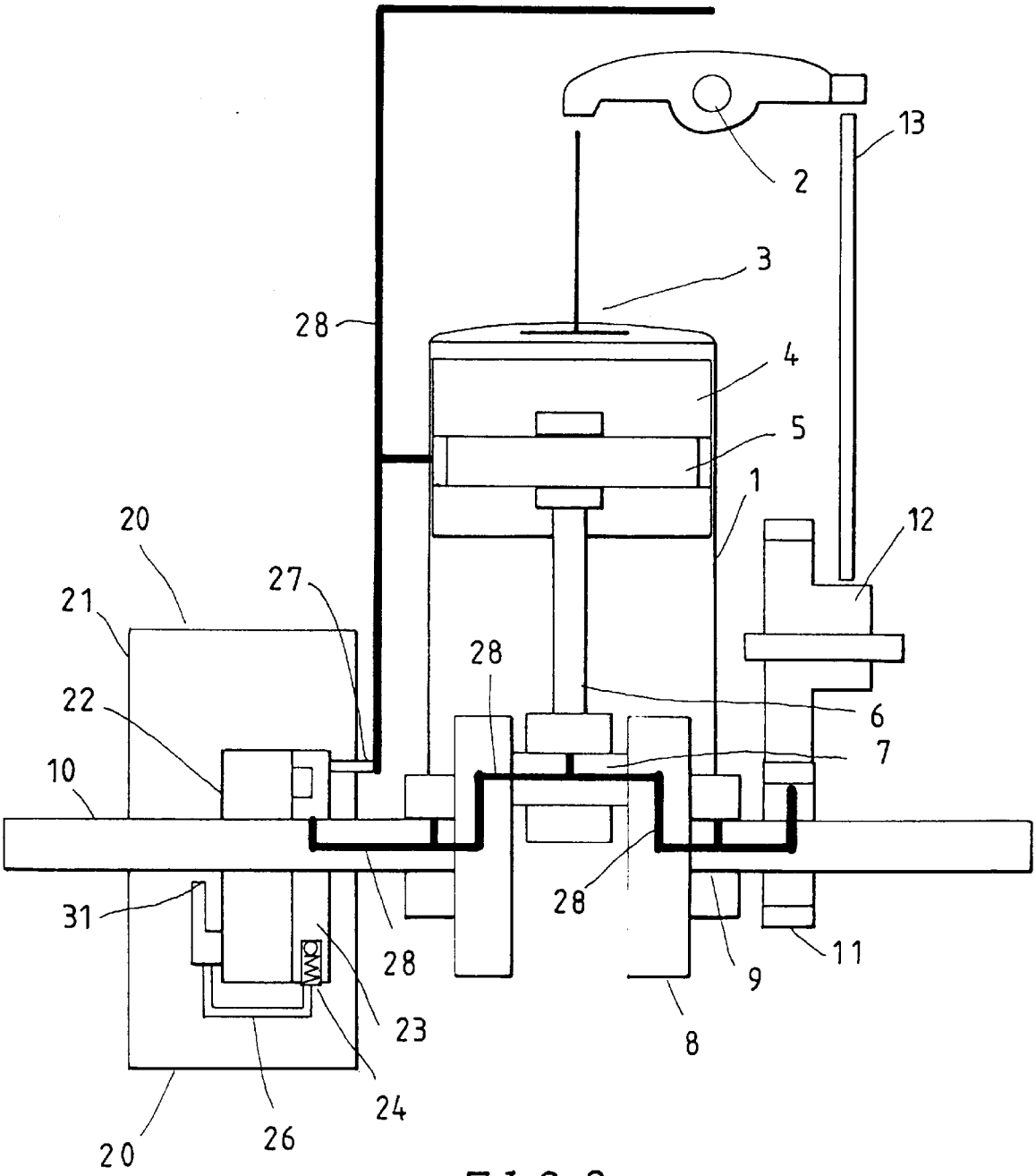
FIG. 3 shows a schematic view of a first preferred embodiment of the present invention in conjunction with a four-stroke over head valve (OHV) engine.

As shown in FIG. 3, the first preferred embodiment of the present invention is employed in a four-stroke over head valve (OHV) engine. The engine oil is conveyed to the timing gear 11 through the internal oil duct 28 of the crankshaft 10. The cam 12, the push rod 13 and the lower rocker arm (not shown in the drawing) are also lubricated by this engine oil.

Figure 4:
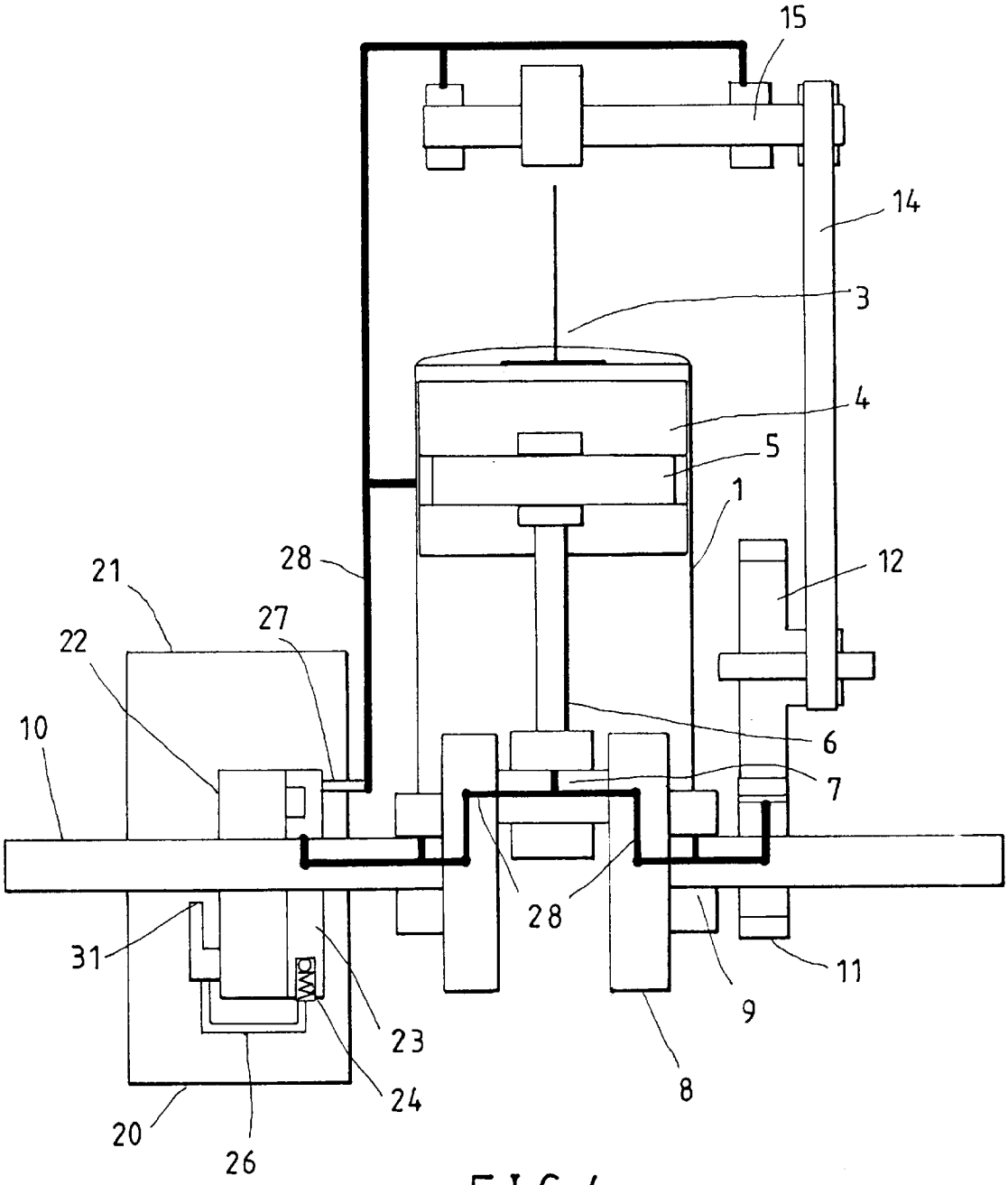
FIG. 4 shows a schematic view of a second preferred embodiment of the present invention in conjunction with a four-stroke over head cam (OHC) engine.

As shown in FIG. 4, the second preferred embodiment of the present invention is applied to a four-stroke over head cam (OHC) engine. The cam shaft 15 is driven by the timing gear 11 via a transmission belt or chain 14. The engine oil is conveyed to the cam shaft 15 via the internal oil duct 28 of the cylinder 1 and cylinder head.

Figure 5:
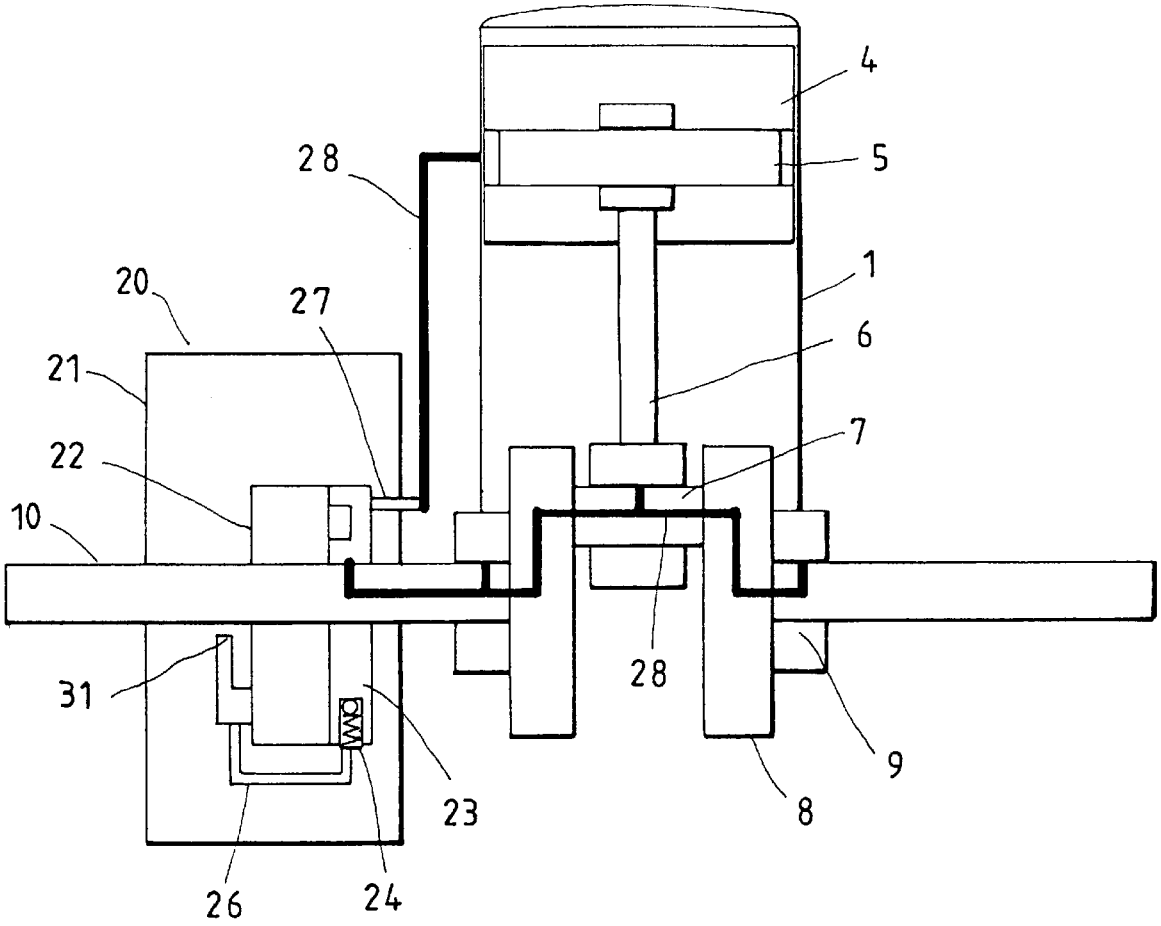
FIG. 5 shows a schematic view of a third preferred embodiment of the present invention in conjunction with a two-stroke engine.

As shown in FIG. 5 the third preferred embodiment of the present invention is applied to a two-stroke engine. The engine oil is conveyed to the engine parts without being mixed with the fuel.

Figure 6:
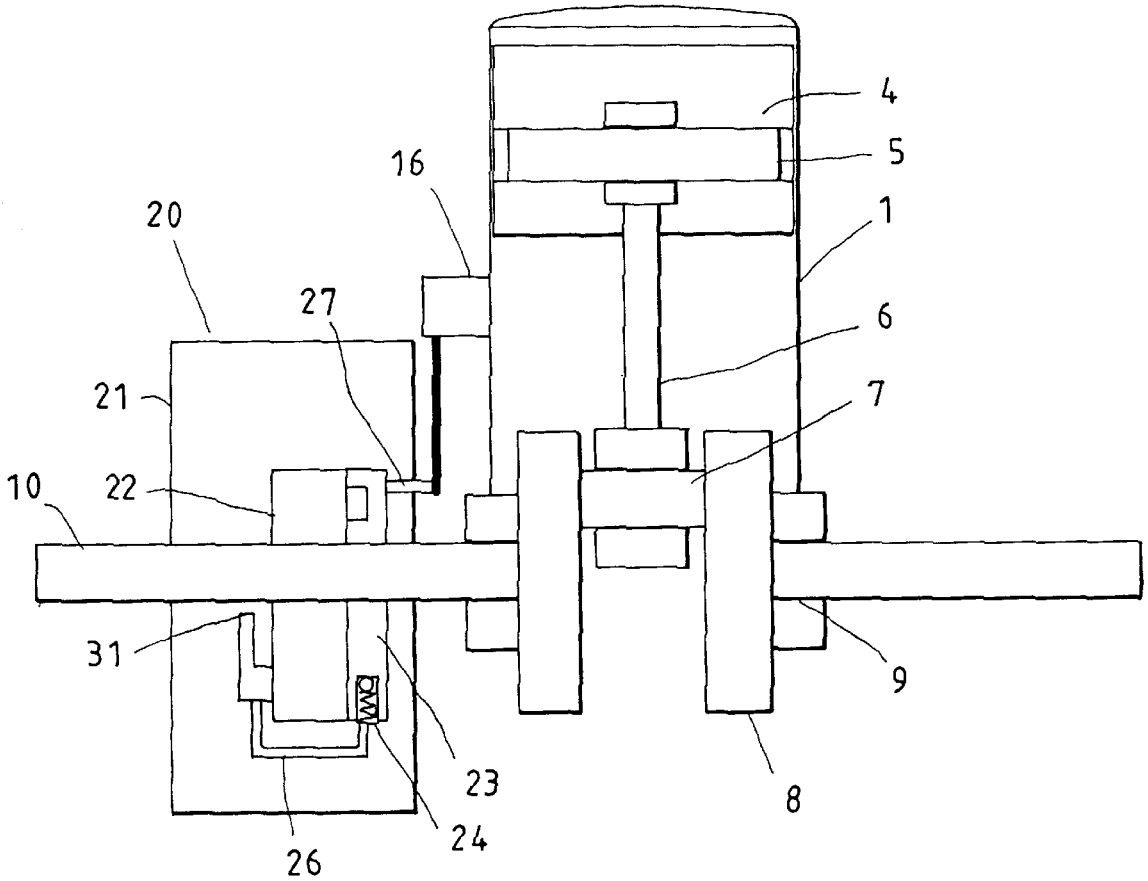
FIG. 6 shows a schematic view of a fourth preferred embodiment of the present invention in conjunction with another two-stroke engine.

As shown in FIG. 6, the fourth preferred embodiment of the present invention is applied to another two-stroke engine consisting of a cylinder 1 which is provided with an air inlet 16. The engine oil is conveyed to the air inlet 16 where the engine oil is mixed with the incoming air. The mixture of air and the engine oil is used to lubricate the piston 4, the piston pin 5, the crankshaft bearing 9, and the crankshaft pin 7.

Figure 7A:
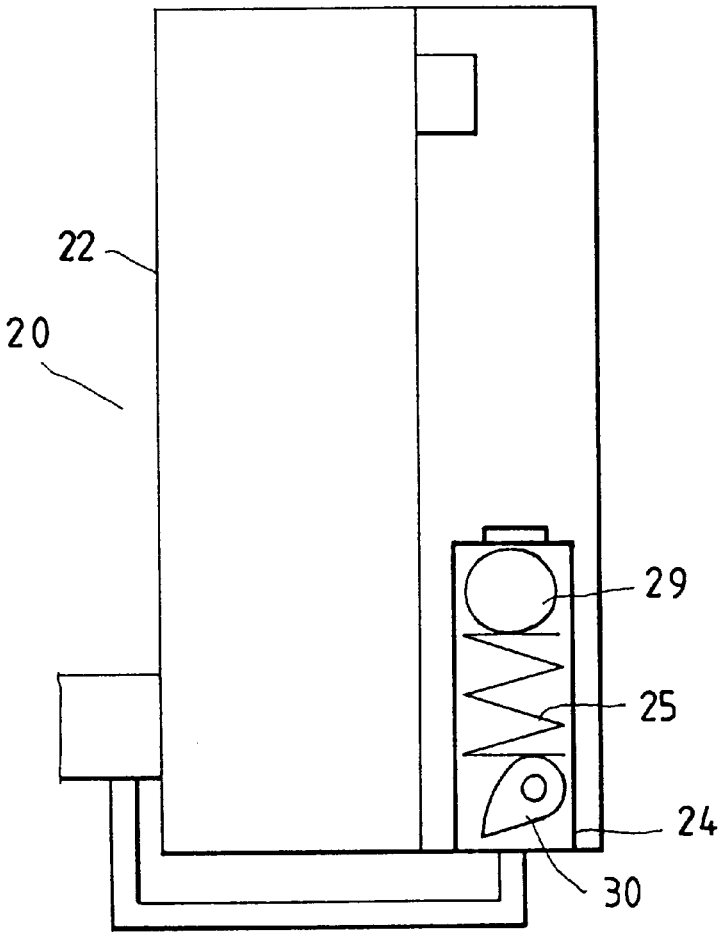
FIG. 7 shows a schematic view of an engine oil pump of a fifth preferred embodiment of the present invention.
Figure 7B:
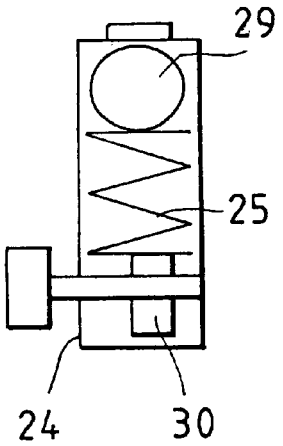

As shown in FIG. 7, the fifth preferred embodiment of the present invention is different from the first preferred embodiment of the present invention in that the former has an engine oil pump which is provided with an engine oil flow control device. The spring 25 of the pressure releasing valve 24 is provided thereunder with a pressure adjusting cam 30 which is linked with the throttle. When the throttle is completely closed, the base circle of the pressure adjusting cam 30 is urged by the spring 25. On the other hand, when the throttle is opened to the fullest extent, the spring 25 is urged by the pressure adjusting cam 30 such that the elastic force of the spring 25 is enhanced. The pressure in the high-pressure chamber 23 is thus increased to result in an increase in the flow rate of the engine oil. In other words, the change in the flow of the engine oil is dependent on the change in the position of the throttle.

The engine oil pump 22 of the present invention may be a gerotor pump, gear pump, plunger pump, or centrifugal pump. In addition, the engine oil pump 22 may be driven directly by the crankshaft 10 or driven indirectly by means of a gear, transmission chain, or transmission belt. The engine oil may be conveyed from the outlet of the engine oil pump 22 to the engine parts without the assistance of the high-pressure chamber 23. The present invention can be therefore embodied in various forms in accordance with the nature of the engine, the design space consideration, the power distribution, etc. The present invention is thus to be limited only by the scopes of the following appended claims.

What is claimed is:

1. A lubrication system of an internal combustion engine, having a crankshaft and a crankcase said lubrication system comprising:

an enclosed engine oil case independent of and spaced apart from the crankcase; and an engine oil pump disposed in said engine oil case such that an inlet of said engine oil pump is located in proximity of a geometrical center of an interior of said engine oil case, said engine oil pump being in a abutting engagement and being driven by the crankshaft and wherein engine oil kept in said interior of said engine oil case is conveyed by said engine oil pump to all moving parts of the internal combustion engine through conduits connecting an outlet of said engine oil pump and the moving parts of the internal combustion engine.

2. The lubrication system as defined in claim 1, wherein said outlet of said engine oil pump is connected to a high-pressure chamber for maintaining engine oil at a high-pressure.

3. The lubrication system as defined in claim 2, wherein the crankshaft of the internal combustion engine is put through said high-pressure chamber and is provided therein with a plurality of conduits in communication with the moving parts of the internal combustion engine.

4. The lubrication system as defined in claim 2, wherein said high-pressure chamber is provided with a pressure releasing valve for setting pressure of engine oil held in said high-pressure chamber.

5. The lubrication system as defined in claim 1, wherein said outlet of said engine oil pump is connected with a plurality of external conduits for conveying engine oil to the moving parts of the internal combustion engine.

6. The lubrication system as defined in claim 4, wherein said pressure releasing valve is linked with a throttle of the internal combustion engine.

7. A lubrication system of an internal combustion engine, said lubrication system comprising:

an engine oil case independent of the internal combustion engine; and an engine oil pump disposed in said engine oil case such that an inlet of said engine oil pump is located in proximity of a geometrical center of an interior of said engine oil case, and that engine oil kept in said interior of said engine oil case is conveyed by said engine oil pump to all moving parts of the internal combustion engine via conduits connecting an outlet of said engine oil pump and the moving parts of the internal combustion engine;

wherein said outlet of said engine oil pump is connected with a high-pressure chamber for keeping high-pressure engine oil;

wherein a crankshaft of the internal combustion engine is put through said high-pressure chamber and is provided therein with a plurality of conduits in communication with the moving parts of the internal combustion engine.

8. The lubrication system as defined in claim 7, wherein said high pressure chamber is provided with a pressure releasing valve for setting pressure of engine oil held in said high-pressure chamber.

9. The lubrication system as defined in claim 7, wherein said outlet of said engine oil pump is connected with a plurality of external conduits for conveying engine oil to the moving parts of the internal combustion engine.

10. The lubrication system as defined in claim 8, wherein said pressure releasing valve is linked with a throttle of the internal combustion engine.

11. A lubrication system of an internal combustion engine, having a crankshaft and a crankcase, said lubrication system comprising:

an enclosed engine oil case independent of and spaced apart from the crankcase; and an engine oil pump disposed in said engine oil case such that an inlet of said engine oil pump is located in proximity of a geometrical center of an interior of said engine oil case, said engine oil pump being in a abutting engagement and being driven by the crankshaft and wherein engine oil kept in said interior of said engine oil case is conveyed by said engine oil pump to all moving parts of the internal combustion engine through conduits connecting an outlet of said engine oil pump and the moving parts of the internal combustion engine;

wherein said outlet of said engine oil pump is connected to a high-pressure chamber for maintaining engine oil at a high-pressure;

wherein the crankshaft of the internal combustion engine is put through said high-pressure chamber and is provided therein with a plurality of conduits in communication with the moving parts of the internal combustion engine.

12. The lubrication system as defined in claim 11, wherein said high pressure chamber is provided with a pressure releasing valve for setting pressure of engine oil held in said high-pressure chamber.

13. The lubrication system as defined in claim 11, wherein said outlet of said engine oil pump is connected with a plurality of external conduits for conveying engine oil to the moving parts of the internal combustion engine.

14. The lubrication system as defined in claim 12, wherein said pressure releasing valve is linked with a throttle of the internal combustion engine.

* * * * *